US006048001A

United States Patent [19]

Miller et al.

[11] Patent Number: 6,048,001

[45] Date of Patent: Apr. 11, 2000

[54] PUSH-BUTTON ACTUATED LATCHING MECHANISM

[76] Inventors: Seth A. Miller, 319 Margaret King Ave.; Kenneth W. Schneider, 9 Tomahawk Path, both of Ringwood, N.J. 07456

[21] Appl. No.: 09/047,069

[22] Filed: Mar. 24, 1998

Related U.S. Application Data

[60] Provisional application No. 60/042,895, Mar. 31, 1997.

[51] Int. Cl.[7] ..... E05C 3/06

[52] U.S. Cl. ..... 292/198; 292/220; 292/194

[58] Field of Search ..... 292/198, 203, 292/216, 220, 336.3; 70/DIG. 73, DIG. 31, 224

[56] References Cited

U.S. PATENT DOCUMENTS

| | | | |
|---|---|---|---|
| 1,435,971 | 11/1922 | Mueller | 292/198 |
| 1,711,213 | 4/1929 | Smith | 292/198 |
| 1,738,648 | 12/1929 | Hall | 292/198 |
| 1,789,775 | 1/1931 | Russ et al. | 292/198 |
| 1,944,470 | 1/1934 | Schlage | 70/DIG. 73 |
| 2,121,531 | 6/1938 | Murphy . | |
| 2,138,251 | 11/1938 | Lindstrom et al. | 292/198 |
| 2,146,379 | 2/1939 | Rediger | 292/198 |
| 2,174,078 | 9/1939 | Burgin | 292/198 |
| 2,217,098 | 10/1940 | Browne | 292/198 |
| 2,910,859 | 11/1959 | Allen et al. | 292/198 |
| 3,002,778 | 10/1961 | Chanaryn et al. . | |
| 3,652,113 | 3/1972 | Odend'hal et al. . | |
| 3,677,591 | 7/1972 | Waldo . | |
| 4,073,170 | 2/1978 | Miyabayashi et al. . | |
| 4,538,844 | 9/1985 | Watanabe . | |
| 4,740,022 | 4/1988 | Takahashi . | |
| 4,932,707 | 6/1990 | Ekstran . | |
| 5,072,974 | 12/1991 | Henneich . | |
| 5,605,064 | 2/1997 | Katayama et al. | 292/336.3 |
| 5,809,815 | 9/1998 | Lee | 70/224 |

FOREIGN PATENT DOCUMENTS

| | | |
|---|---|---|
| 2384087 | 3/1977 | France . |
| 1072145 | 12/1959 | Germany . |
| 640032 | of 1962 | Italy . |
| 2005337 | 4/1979 | United Kingdom . |

*Primary Examiner*—Teri Pham
*Attorney, Agent, or Firm*—Arthur Jacob

[57] ABSTRACT

A latching mechanism selectively maintains a first member and a second member in secured engagement by the interposition of a striker plate, mounted upon the second member, between spaced apart arms carried by a latching cam mounted on the first member for pivotal movement and locked in a latching position against such movement by a locking member, and moves the first member away from the second member upon selective release of the secured engagement by the actuation of a push-button assembly which unlocks the locking member and allows the latching cam to be moved out of the latching position by a biasing spring so that one of the spaced apart arms pushes against the strike plate to move the first member away from the second member. Selective movement of the first member toward the second member engages the one of the spaced apart arms with the strike plate and moves the latching cam against the biasing force of the biasing spring until the locking member locks the latching cam in the latched position, with the strike plate interposed between the spaced apart arms of the latching cam. In the event of a jam, an auxiliary latch retains the locking member in an unlocked position independent of the push-button assembly.

12 Claims, 5 Drawing Sheets

PUSH-BUTTON ACTUATED LATCHING MECHANISM

This application claims the benefit of provisional application Ser. No. 60/042,895, filed Mar. 31, 1997.

The present invention relates generally to latching mechanisms for doors or drawers and pertains, more specifically, to a push-button actuated latching mechanism for maintaining a door or drawer closed and for pushing the door or drawer open upon release of the latching mechanism.

There are many locks and latches for doors and drawers. The present invention provides a more practical and reliable latching mechanism for readily securing and maintaining a door or a drawer closed and for easily opening the door or drawer upon actuating a push-button actuator to release the latching mechanism. As such, the present invention is particularly useful in connection with closing and opening overlay, flush and rabbeted doors and drawers.

The push-button actuated latching mechanism of the present invention is adapted readily to be toddler proof, or child proof; that is, the construction enables the latching mechanism to be fitted with a spring force sufficient to preclude unwanted or accidental unlatching and opening of doors or drawers by children.

The push-button actuator arrangement of the present invention enables the actuator to be placed either flush or slightly protruding from the surface of the door or drawer latched by the latching mechanism, thereby enabling the use of a wide variety of aesthetically pleasing design arrangements.

The present invention permits the use of synthetic polymeric materials for component parts of the latching mechanism for more economical construction, as well as metallic materials.

The prior art is replete with different systems for push-button actuated latches for opening drawers and doors, and especially overlay, flush and rabbeted doors, utilizing push-buttons, latches and cams. The present invention provides a door or drawer locking system having a push-button actuator which releases an eccentric, spring-loaded latching cam, pushing the door or drawer against a strike plate to open the door or drawer, and engaging the strike plate upon reclosing the door or drawer to reload the spring and lock the latching cam to secure the door or drawer closed.

A version of the present invention further provides a safety unlock, which enables easy dislodging should a jam occur. Thus, the latching cam selectively can be released from its latched position and maintained unlatched, in the event of a jam, for ready dislodgement of a jammed door or drawer.

The major component parts of the latching mechanism preferably are constructed of synthetic polymeric materials, for economy, but are suitable for construction of metallic materials.

The above objects and advantages, as well as further objects and advantages, are attained by the present invention which may be described briefly as a latching mechanism for selectively maintaining a first member and a second member in secured engagement and for moving the first member along a first direction away from the second member upon selective release of the secured engagement, the latching mechanism comprising: a strike for mounting upon one of the first and second members, the strike having a securing face and a latching face spaced a distance from the securing face in the first direction; a housing for mounting upon the other of the first and second members; a latching cam mounted in the housing for pivotal movement about a pivotal axis transverse to the first direction, between a latched position and an unlatched position; first and second arms on the cam, the first arm being spaced from the second arm in the first direction and establishing a space between the first and second arms, the space being essentially complementary to the distance between the securing face and the latching face of the strike; first biasing means coupled with the latching cam to bias the first arm for movement in a second direction opposite to the first direction; the first arm protruding from the housing when the latching cam is in the unlatched position so as to move along a first path of travel toward the strike as the first member is moved toward the second member such that the first arm engages the latch face of the strike and the latching cam is driven to move pivotally to the latched position, with the strike entering the space between the first and second arms, in response to selected movement of the first and second members into the secured engagement; a locking member mounted in the housing for movement between a locked position and an unlocked position; a second biasing means biasing the locking member toward the locked position; a locking element coupled with the latching cam for engagement with the locking member when the locking member is in the locked position and the latching cam is in the latched position to lock the latching cam in the latched position, with the second arm protruding from the housing and abutting the securing face of the strike to maintain the first and second members in the secured engagement; and an actuator coupled with the housing for movement along a second path of travel between a retracted position and an advanced position, the second path of travel intercepting the locking member such that upon movement of the actuator from the retracted position toward the advanced position, the actuator is coupled with the locking member to move the locking member, against the bias of the second biasing means, to the unlocked position, where the locking member is disengaged from the locking element to free the latching cam for movement toward the unlatched position in response to the first biasing means; whereby the second arm is biased by the first biasing means away from the securing face of the strike, and the first arm is biased by the first biasing means against the latching face of the strike to move the first member along the first direction away from the second member. In some embodiments, an auxiliary latch is coupled with the latching cam, the auxiliary latch being coupled with the latching cam such that upon movement of the locking member out of the locked position, when the latching cam is in the latched position, the auxiliary latch engages the locking member to maintain the locking member disengaged from the locking element independent of the position of the actuator.

The invention will be understood more fully, while further objects and advantages will become apparent, in the following detailed description of embodiments of the invention illustrated in the accompanying drawing, in which.

Figure 1:
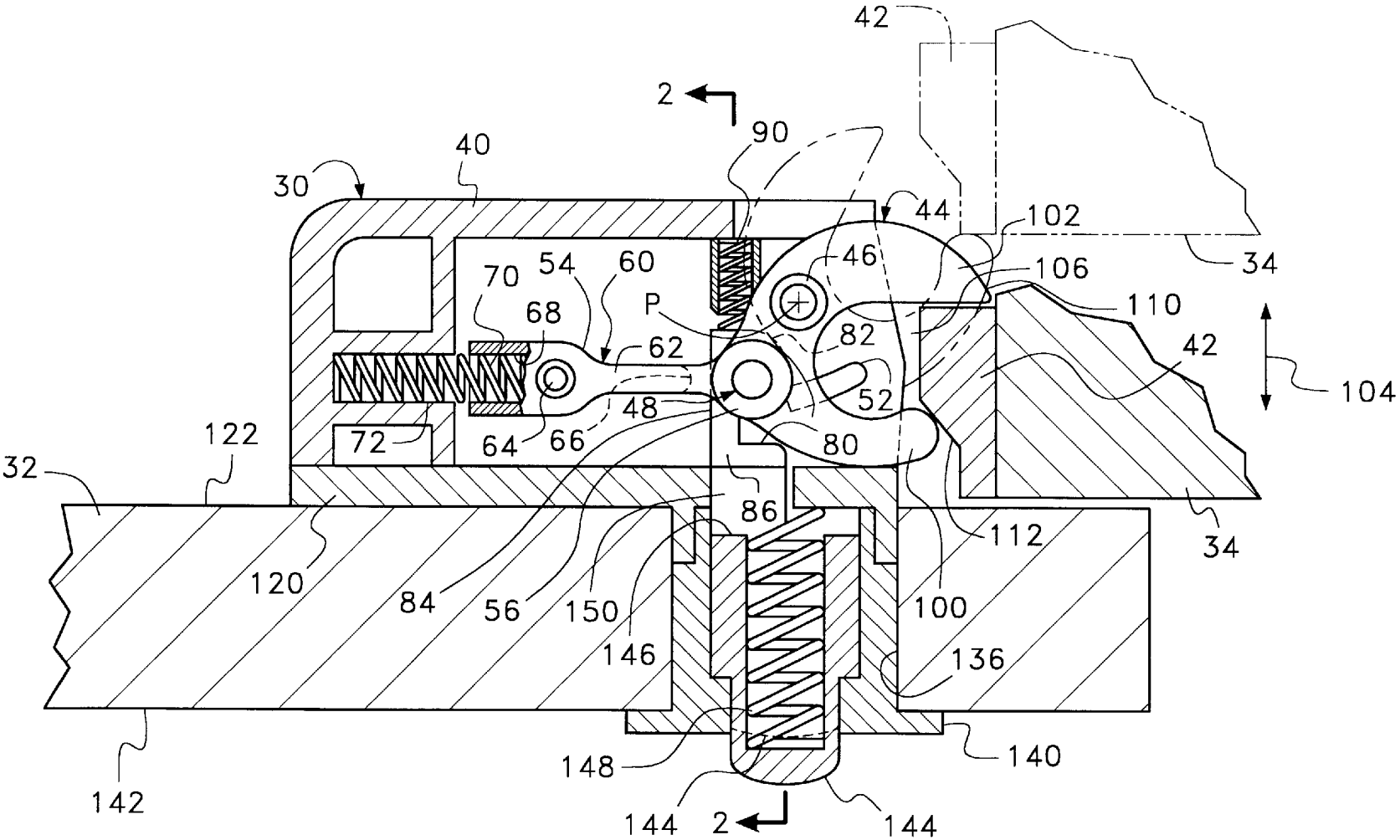
FIG. 1 is an enlarged top longitudinal cross-sectional view of a latching mechanism constructed in accordance with the present invention, installed for latching a door.
Figure 10:
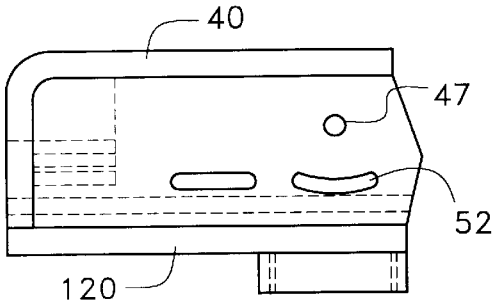
FIG. 10 is a fragmentary top plan view of a portion of a component part shown in FIG. 1.

Referring now to the drawing, in which like reference characters denote like parts throughout the various figures, a latching mechanism constructed in accordance with the present invention is illustrated generally at 30 and is seen, in FIG. 1, installed upon a first member in the form of a door 32 which is maintained by the latching mechanism 30 in secured engagement with a second member in the form of a frame 34 to be held in a closed door position. Latching mechanism 30 includes a housing 40 mounted upon the door 32 and a strike in the form of a strike plate 42 mounted on the frame 34. A latching cam 44 is mounted for pivotal movement within the housing 40 by means of rearward posts 46 on the latching cam 44 which are journaled within complementary holes 47 in the housing 40 (see FIG. 10) to enable pivotal movement of the latching cam 44 about a pivotal axis P, between a latched position, shown in full lines, and an unlatched position, illustrated in phantom. Forward posts 48 on the latching cam 44 each include a distal portion 50 (see FIG. 2) which rides within a complementary curved guide slot 52 in the housing 40 (see also FIG. 10) to confine movement of latching cam 44 to pivotal movement between the latched and unlatched positions.

Figure 4:
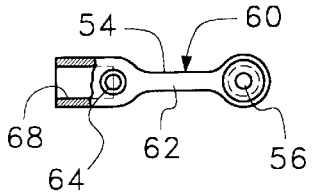
FIG. 4 is a top plan view, reduced in size, of the component of FIG. 3.
Figure 5:
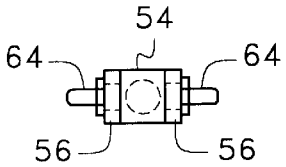
FIG. 5 is a side elevational view of the component of FIG. 4.
Figure 6:
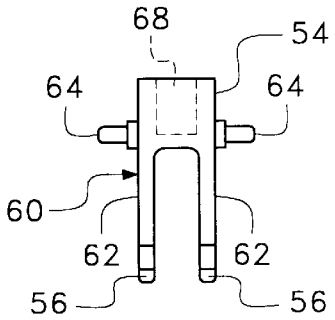
FIG. 6 is a rear elevational view of the component part of FIG. 4.

A push rod 54 is coupled with the latching cam 44 by means of bearings 56 (see FIGS. 4 through 6) on the push rod 54 each bearing 56 being journaled with a counterpart proximal portion 58 (see FIG. 2) of a forward post 48. Push rod 54 includes a yoke 60 having arms 62 which carry the bearings 56, and a pair of pins 64 projecting from the push rod 54 so as to engage complementary straight slots 66 in the housing 40 (see FIG. 10) to confine movement of the push rod 54 to linear movement corresponding to the pivotal movement of the latching cam 44 between the latched and unlatched positions. A biasing means includes a bore 68 in the push rod 54 receiving a compression spring 70 which extends into a recess 72 in the housing 40 to bias the push rod 54 to the right, as seen in FIG. 1, and thereby exert a biasing force on the latching cam 44 tending to pivot the latching cam 44 from the latched position to the unlatched position.

Figure 2:
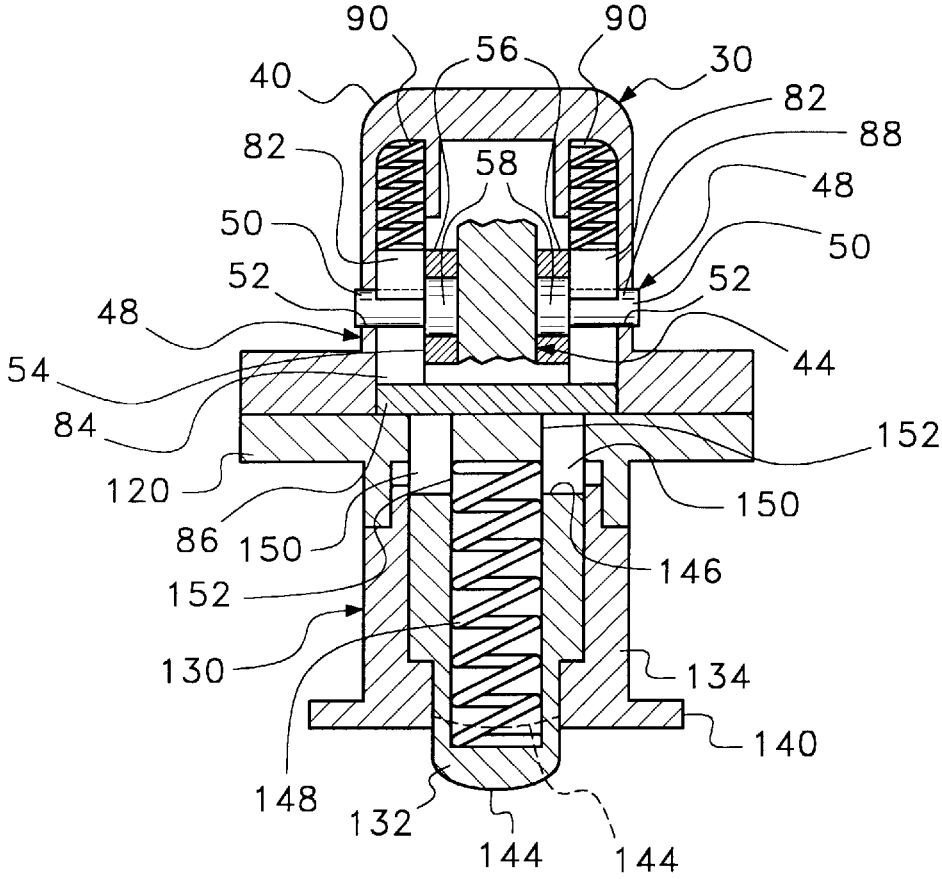
FIG. 2 is a cross-sectional view taken along line 2—2 of FIG. 1.
Figure 7:
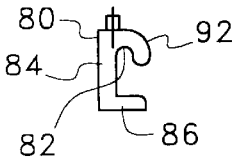
FIG. 7 is a top plan view of another component part.
Figure 8:
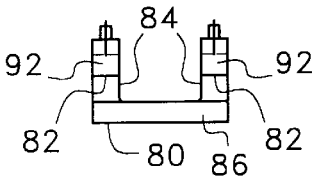
FIG. 8 is a side elevational view of the component part of FIG. 7.
Figure 9:
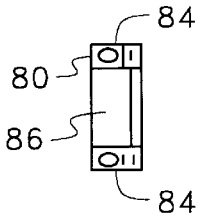
FIG. 9 is a rear elevational view of the component part of FIG. 7.

A locking member in the form of a support hook 80, shown in detail in FIGS. 7 through 9, is mounted in the housing 40 for linear movement back and forth between a forward, locked position and a rearward, unlocked position. Support hook 80 is U-shaped, as seen in FIGS. 2 and 8, and includes hooked portions 82 located on arms 84 which extend from a base 86 of the U-shaped configuration. In the locked position of support hook 80, the hooked portions 82 are engaged with locking elements in the form of intermediate portions 88 of the forward posts 48 and retain the latching cam 44 in the latched position. compression springs 90 extend between the housing 40 and the support hook 80 to bias the support hook 80 into the locked position. Each hooked portion 82 includes a camming surface 92 for purposes which will be described below.

When the latching cam 44 is in the latched position, latching mechanism 30 is in latching engagement and the door 32 is maintained in secured engagement within the frame 34 by virtue of the interposition of the strike plate 42 between a first, or forward arm 100 on the latching cam 44 and a second, or rearward arm 102 on the latching cam 44. The arms 100 and 102 protrude from the housing 40 toward the strike plate 42, and rearward arm 102 is spaced from the forward arm 100 in the forward-rearward direction 104 a distance which establishes a space 106 between the arms 100 and 102 to accommodate the strike plate 42. Thus, the strike plate 42 includes a securing face 110 and a latching face 112 spaced from the securing face 110 a distance along the direction 104. The space 106 between the arms 100 and 102 of the latching cam 44 is complementary to the distance between the securing face 110 and the latching face 112 of the strike plate 42 so that the interposition of the strike plate 42 between the arms 100 and 102, with the latching cam 44 locked in the latched position and at least the arm 102 abutting the strike plate 42 at the securing face 110, secures the door 32 against movement relative to the frame 34 and holds the door 32 closed.

Figure 3:
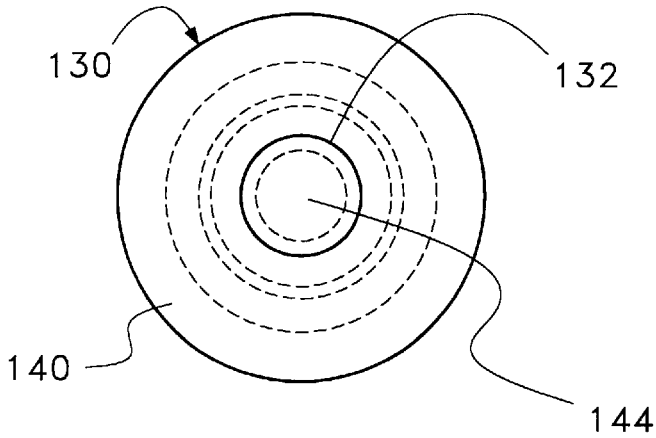
FIG. 3 is a front elevational view of a component part of the latching mechanism shown in FIG. 1.

Housing 40 includes a base plate 120 which is secured against the inside surface 122 of door 32. An actuator is shown in the form of a push-button assembly 130 engaged with the door 32 and including a push-button 132 received for linear sliding movement within a sleeve 134 secured in a bore 136 in the door 32 and having an integral escutcheon plate 140 engaging outer surface 142 of the door 32 (also see FIG. 3). Push-button 132 has a button end 144 accessible for being actuated by the finger of a person using the latching mechanism 30, and an opposite end 146 adjacent the base plate 120 for operating the latching mechanism 30, as will be described below. A second biasing means includes a spring 148 placed within the push-button 132 and engaging the base plate 120 to bias the push-button 132 forward. In the illustrated preferred embodiment, the button end 144 protrudes from the escutcheon plate 140 for easy access; however, for aesthetic purposes, the button end 144 may be made flush with the escutcheon plate 140. In either case, the push-button 132 is accessible for being pushed, or depressed, from a retracted position, as seen in full lines in FIG. 1, to an advanced position, as illustrated in phantom.

Figure 11:
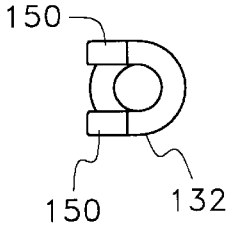
FIG. 11 is a rear elevational view of still another component part.
Figure 12:
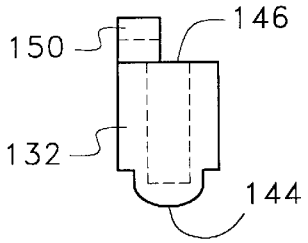
FIG. 12 is a top plan view of the component part of FIG. 11.
Figure 13:
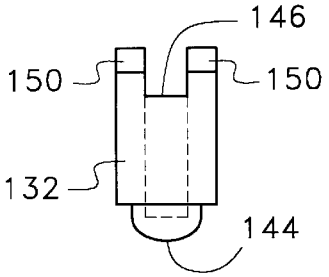
FIG. 13 is a side elevational view of the component of FIG. 11.
Figure 14:
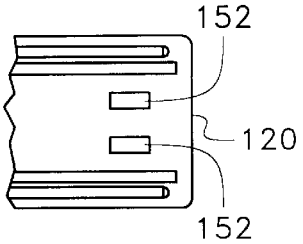
FIG. 14 is a fragmentary front elevational view of the component part shown in FIG. 10.

Upon selective movement of the push-button 132 from the retracted position to the advanced position, a pair of tines 150 at the opposite end 146 of the push-button 132 (see FIGS. 11 through 13), which extend through complementary apertures 152 in the base plate 120 (see FIG. 14), engage the support hook 80 and move the support hook 80 from the locked position to the unlocked position, against the biasing force of the springs 90, disengaging the hooked portions 82 from the intermediate portions 88 of the forward posts 48, and thereby freeing the latching cam 44 for pivotal movement from the latched position to the unlatched position, in response to the biasing force of the compression spring 70. Such pivotal movement of the latching cam 44 pushes the forward arm 100 of the latching cam 44 against the latching face 112 of the strike plate 42, while at the same time moving the rearward arm 102 away from the securing face 110 of the strike plate 42, so that the strike plate 42 is disengaged from between the arms 100 and 102 and the door 32 is moved forward, along a first path of travel generally parallel to the in a release direction away from and out of the frame 34, to open the door 32, as illustrated in phantom in FIG. 1, the pivotal axis P being transverse to the direction 104.

Upon closing the door 32, the forward arm 100 of the latching cam 44 moves rearward along a second path of travel in a direction opposite to the forward direction of movement along the first path of travel to be intercepted by the strike plate 42 to engage the latching face 112 of the strike plate 42, and the latching cam 44 is moved pivotally from the unlatched position to the latched position, against the bias of the compression spring 70. The lower posts 48 ride over the camming surfaces 92 of the hooked portions 82 of the support hook 80 to become captured by the hooked portions 82 so that the latching cam 44 is locked in the latched position and the strike plate 42 once again is interposed between the arms 100 and 102 of the latching cam 44 to secure the door 32 closed. At the same time, the compression spring 70 is loaded for providing the biasing force necessary to open the door 32 upon actuation of the push-button assembly 130 to release the locking engagement of the support hook 80.

In order to render the latching mechanism "child-proof", the spring 148 which biases the push-button 132 into the retracted position may be provided with a spring rate great enough to prevent depression of the push-button 132 by a child.

Figure 15:
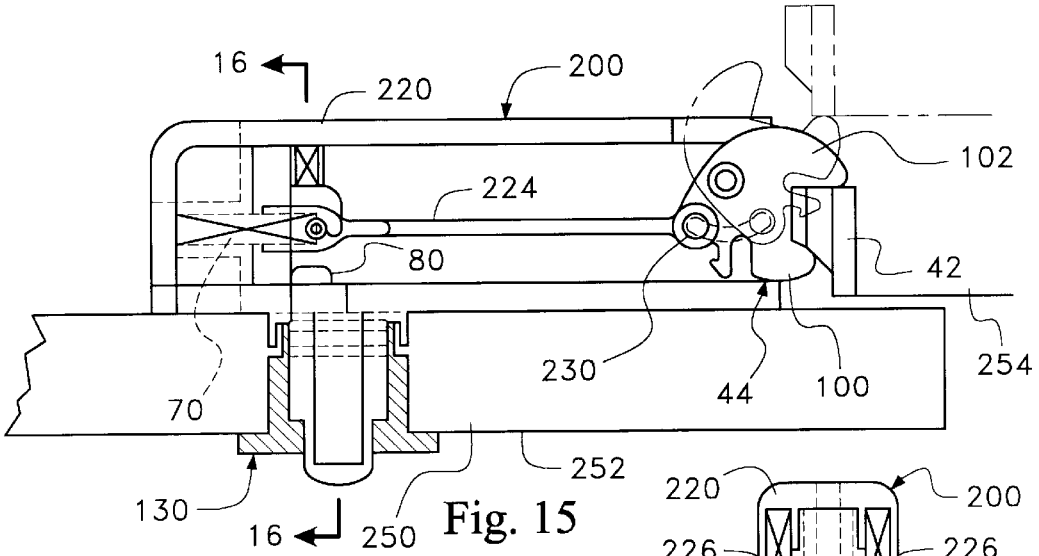
FIG. 15 is a top plan longitudinal cross-sectional view similar to FIG. 1 and showing another embodiment of a latching mechanism constructed in accordance with the present invention, installed for latching a drawer.
Figure 17:
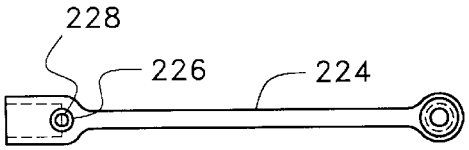
FIG. 17 is a top plan view of a component part of the latching mechanism of FIG. 15.
Figure 16:
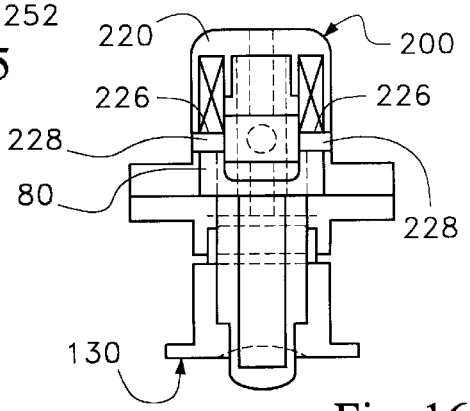
FIG. 16 is a cross-sectional view taken along line 16—16 of FIG. 15.

Turning now to the embodiment of the invention illustrated in FIGS. 15 through 17, where like components are identified by the same reference characters as found in the above description, in order to enable more flexibility in the location of the push-button assembly 130 relative to the latching cam 44 and the strike plate 42, the latching mechanism 200 includes an elongate housing 220 for accommodating a longer push rod 224. The support hook 80 is located remote from the latching cam 44 and engages locking portions 226 of a pair of pins 228 projecting from the push rod 224 in order to lock the push rod 224 in a locked position shown in full lines in FIG. 15. The push rod 224 is coupled with the latching cam 44 at 230 so that when the push rod 224 is in the locked position, the latching cam 44 is in the latched position, also shown in full lines, with the strike plate 42 engaged between the arms 100 and 102 of the latching cam 44. In this instance, the latching mechanism 200 is installed in a drawer face 250 of a drawer 252 so that the drawer 252 is maintained in secured engagement with a cabinet 254 to secure the drawer 252 closed. The drawer 252 is opened selectively by actuating the push-button assembly 130, as described above, to move the support hook 80 to the unlocked position and release the push rod 224 for movement in response to the biasing force of compression spring 70.

Figure 18:
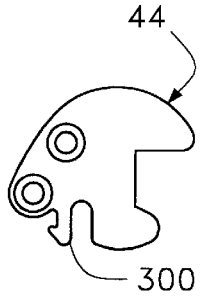
FIG. 18 is a front elevational view of an alternate component part employed in another embodiment of the present invention.
Figure 20:
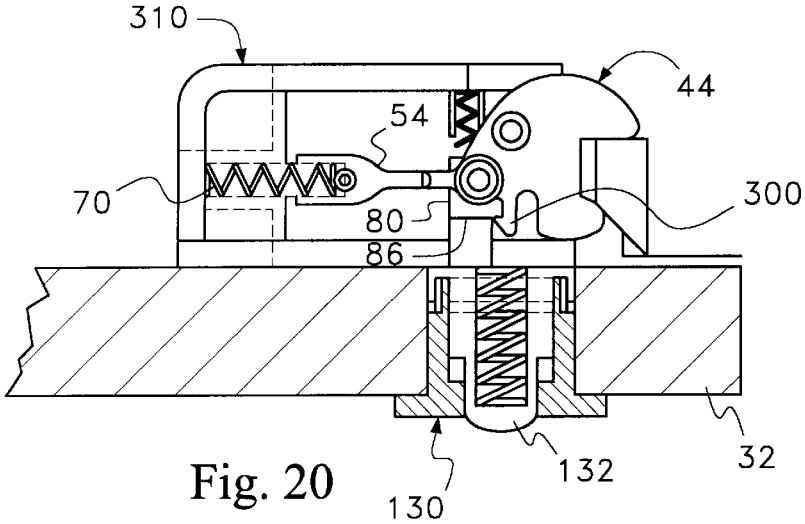
Figure 21:
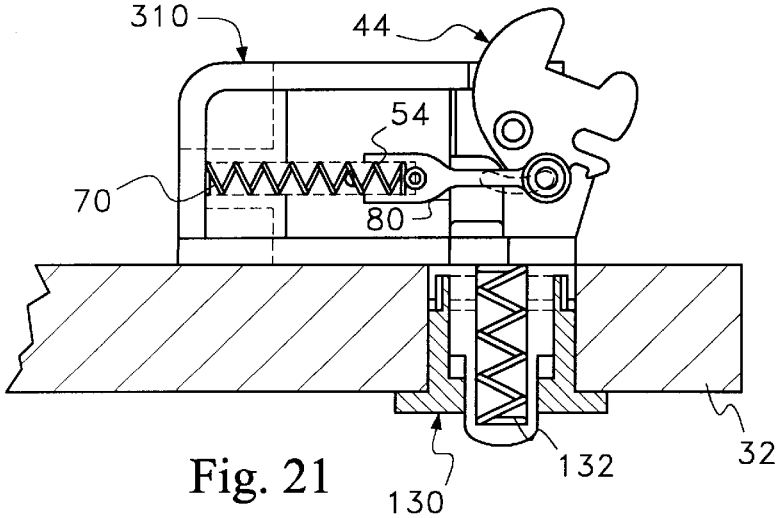

The embodiment illustrated in FIGS. 18 through 21 employs an auxiliary latch in the form of a tail-hook 300 on the latching cam 44, as seen in FIG. 18. Should the door 32 become jammed within the frame 32, due to external conditions, the biasing force of the compression spring 70 may not be sufficient to overcome the jamming force to open the door 32. Under those circumstances, the push-button assembly 130 is actuated to move the support hook 80 out of the locked position (FIG. 19) until the tail-hook 300 engages the support hook 80 to retain the support hook 80 out of the locked position (FIG. 20) and free the latching cam 44 for pivotal movement independent of the position of the push-button 132. In this manner, the door 32 can be moved manually to force the door 32 open, with the latching cam 44 able to move freely from the latched position to the unlatched position (FIG. 21), and enabling resetting of the support hook 80 to the locked position, ready for reclosing of the door 32 and securement of the door 32 within the frame 34 by the latching mechanism 310. In the preferred arrangement, the support hook 80 is pushed by the push-button 132 slightly beyond the unlocked position, enabling the tail-hook 300 to engage the support hook 80 beneath the base 86 of the support hook 80, as shown in FIG. 21.

Figure 22:
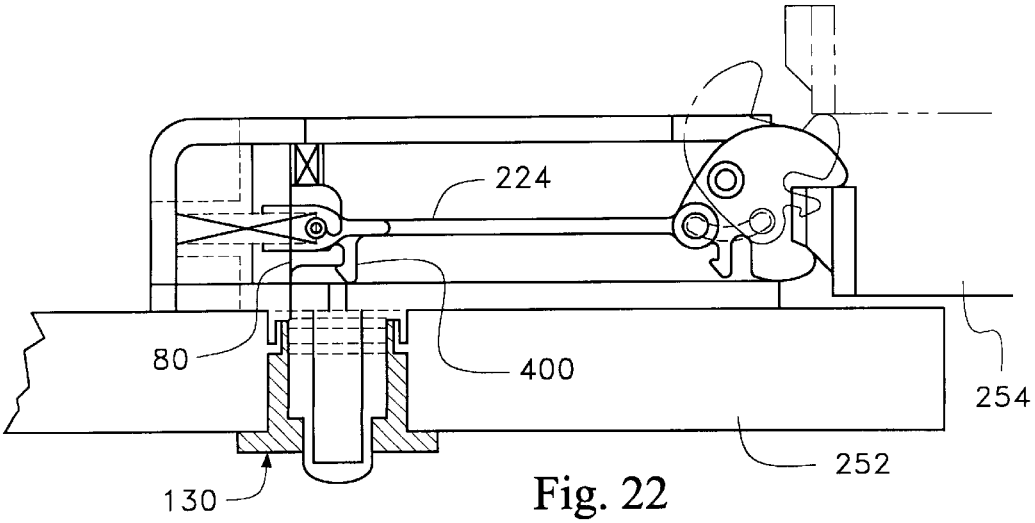
FIG. 22 is a top plan longitudinal cross-sectional view similar to FIG. 15 and showing yet another embodiment of a latching mechanism constructed in accordance with the present invention, installed for latching a drawer.
Figure 23:
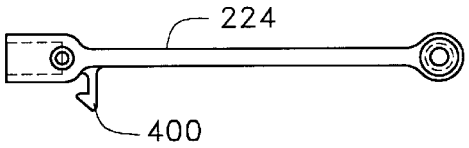
FIG. 23 is a top plan view of a component part of the latching mechanism of FIG. 22.
Figure 19:
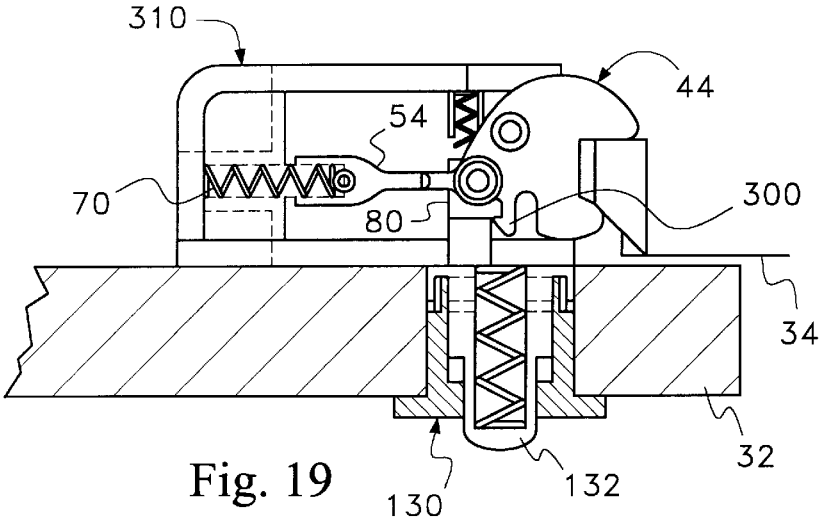
FIGS. 19 through 21 are top plan longitudinal cross-sectional views similar to FIG. 1 and showing the operation of the embodiment which incorporates the component part of FIG. 18.

In the embodiment illustrated in FIGS. 22 and 23, an auxiliary latch is shown in the form of a tail-hook 400 located on the push rod 224 for engagement with the support hook 80 in a manner similar to that described above in connection with the operation of tail-hook 300.

It is to be understood that the above detailed description of preferred embodiments of the invention are provided by way of example only. Various details of design and construction may be modified without departing from the true spirit and scope of the invention as set forth in the appended claims.

What is claimed is:

1. A latching mechanism for selective latching engagement to maintain a first member and a second member in secured engagement and for moving the first member along a release direction away from the second member upon selective release of the latching engagement, the latching mechanism comprising:

a strike for mounting upon one of the first and second members, the strike having a securing face and a latching face spaced a distance from the securing face in a first direction, the first direction corresponding to the release direction when the strike is mounted upon one of the first and second members;

a housing for mounting upon the other of the first and second members;

a latching cam mounted in the housing for pivotal movement about a pivotal axis transverse to the first direction, between a latched position and an unlatched position;

first and second arms on the cam, the first arm being spaced from the second arm in the first direction and establishing a space between the first and second arms, the space being essentially complementary to the distance between the securing face and the latching face of the strike;

first biasing means coupled with the latching cam for exerting a biasing force on the latching cam, the biasing force being directed so as to always bias the first arm for movement in a second direction opposite to the first direction;

the first arm protruding from the housing when the latching cam is in the unlatched position so as to move along a first path of travel toward the strike as the latching cam is moved toward the striker such that the first arm engages the latch face of the strike and the latching cam is driven to move pivotally to the latched position, with the strike entering the space between the first and second arms, in response to selected movement of the latching cam toward the strike to move the latching mechanism into the latching engagement;

a locking member mounted in the housing for movement between a locked position and an unlocked position;

a second biasing means biasing the locking member toward the locked position;

a locking element coupled with the latching cam for engagement with the locking member when the locking member is in the locked position and the latching cam is in the latched position to lock the latching cam in the latched position, against the biasing force, with the second arm protruding from the housing and abutting the securing face of the strike to maintain the latching mechanism in the latching engagement; and an actuator coupled with the housing for movement along a second path of travel between a retracted position and an advanced position, the second path of travel intercepting the locking member such that upon movement of the actuator from the retracted position toward the advanced position, the actuator is coupled with the locking member to move the locking member, against the bias of the second biasing means, to the unlocked position, where the locking member is disengaged from the locking element to free the latching cam for movement toward the unlatched position in response to the biasing force of the first biasing means;

whereby the second arm is biased by the first biasing means away from the securing face of the strike, and the first arm is biased by the first biasing means against the latching face of the strike to move the latching cam along the first direction away from the strike for moving the first member along the release direction away from the second member when the strike is mounted upon one of the first and second members and the housing is mounted upon the other of the first and second members.

2. The latching mechanism of claim 1 wherein the locking element is located on the latching cam.

3. The latching mechanism of claim 1 wherein the actuator includes a push-button movable along the second path of travel.

4. A latching mechanism for selective latching engagement to maintain a first member and a second member in secured engagement and for moving the first member along a release direction away from the second member upon selective release of the latching engagement, the latching mechanism comprising:

a strike for mounting upon one of the first and second members, the strike having a securing face and a latching face spaced a distance from the securing face in a first direction, the first direction corresponding to the release direction when the strike is mounted upon one of the first and second members;

a housing for mounting upon the other of the first and second members;

a latching cam mounted in the housing for pivotal movement about a pivotal axis transverse to the first direction, between a latched position and a unlatched position;

first and second arms on the cam, the first arm being spaced from the second arm in the first direction and establishing a space between the first and second arms, the space being essentially complementary to the distance between the securing face and the latching face of the strike;

first biasing means coupled with the latching cam to bias the first arm for movement in a second direction opposite to the first direction;

the first arm protruding from the housing when the latching cam is in the unlatched position so as to move along a first path of travel toward the strike as the latching cam is moved toward the striker such that the first arm engages the latch face of the strike and the latching cam is driven to move pivotally to the latched position, with the strike entering the space between the first and second arms, in response to selected movement of the latching cam toward the strike to move the latching mechanism into the latching engagement;

a locking member mounted in the housing for movement between a locked position and an unlocked position;

a second biasing means biasing the locking member toward the locked position;

a locking element coupled with the latching cam for engagement with the locking member when the locking member is in the locked position and the latching cam is in the latched position to lock the latching cam in the latched position, with the second arm protruding from the housing and abutting the securing face of the strike to maintain the latching mechanism in the latching engagement; and an actuator coupled with the housing for movement along a second path of travel between a retracted position and an advanced position, the second path of travel intercepting the locking member such that upon movement of the actuator from the retracted position toward the advanced position, the actuator is coupled with the locking member to move the locking member, against the bias of the second biasing means, to the unlocked position, where the locking member is disengaged from the locking element to free the latching cam for movement toward the unlatched position in response to the first biasing means;

whereby the second arm is biased by the first biasing means away from the securing face of the strike, and the first arm is biased by the first biasing means against the latching face of the strike to move the latching cam along the first direction away from the strike for moving the first member along the release direction away from the second member when the strike is mounted upon one of the first and second members and the housing is mounted upon the other of the first and second;

the actuator including a push-button movable along the second path of travel, being linear and generally parallel to the first direction.

5. The latching mechanism of claim 4 wherein the locking member is mounted for movement in directions generally parallel to the second path of travel.

6. A latching mechanism for selective latching engagement to maintain a first member and a second member in secured engagement and for moving the first member along a release direction away from the second member upon selective release of the latching engagement, the latching mechanism comprising:

a strike for mounting upon one of the first and second members, the strike having a securing face and a latching face spaced a distance from the securing face in a first direction, the first direction corresponding to the release direction when the strike is mounted upon one of the first and second members;

a housing for mounting upon the other of the first and second members;

a latching cam mounted in the housing for pivotal movement about a pivotal axis transverse to the first direction, between a latched position and a unlatched position;

first and second arms on the cam, the first arm being spaced from the second arm in the first direction and establishing a space between the first and second arms, the space being essentially complementary to the distance between the securing face and the latching face of the strike;

first biasing means coupled with the latching cam to bias the first arm for movement in a second direction opposite to the first direction;

the first arm protruding from the housing when the latching cam is in the unlatched position so as to move along a first path of travel toward the strike as the latching cam is moved toward the striker such that the first arm engages the latch face of the strike and the latching cam is driven to move pivotally to the latched position, with the strike entering the space between the first and second arms, in response to selected movement of the latching cam toward the strike to move the latching mechanism into the latching engagement;

a locking member mounted in the housing for movement between a locked position and an unlocked position;

a second biasing means biasing the locking member toward the locked position;

a locking element coupled with the latching cam for engagement with the locking member when the locking member is in the locked position and the latching cam is in the latched position to lock the latching cam in the latched position, with the second arm protruding from the housing and abutting the securing face of the strike to maintain the latching mechanism in the latching engagement;

an actuator coupled with the housing for movement along a second path of travel between a retracted position and an advanced position, the second path of travel intercepting the locking member such that upon movement of the actuator from the retracted position toward the advanced position, the actuator is coupled with the locking member to move the locking member, against the bias of the second biasing means, to the unlocked position, where the locking member is disengaged from the locking element to free the latching cam for movement toward the unlatched position in response to the first biasing means;

whereby the second arm is biased by the first biasing means away from the securing face of the strike, and the first arm is biased by the first biasing means against the latching face of the strike to move the latching cam along the first direction away from the strike for moving the first member along the release direction away from the second member when the strike is mounted upon one of the first and second members and the housing is mounted upon the other of the first and second members; and an auxiliary latch coupled with the latching cam, the auxiliary latch being coupled with the latching cam such that upon movement of the locking member out of the locked position, when the latching cam is in the latching position, the auxiliary latch engages the locking member to maintain the locking member disengaged from the locking element independent of the position of the actuator.

7. The latching mechanism of claim 6 wherein the auxiliary latch is located so as to engage the locking member when the locking member is placed in the vicinity of the unlocked position.

8. The latching mechanism of claim 6 wherein the auxiliary latch is located so as to engage the locking member when the locking member is moved beyond the unlocked position in a direction away from the locked position.

9. The latching mechanism of claim 6 wherein the auxiliary latch is located on the latching cam.

10. The latching mechanism of claim 6 wherein the actuator includes a push-button movable along the second path of travel.

11. The latching mechanism of claim 10 wherein the second path of travel is linear and is generally parallel to the first direction.

12. The latching mechanism of claim 11 wherein the locking member is mounted for movement in directions generally parallel to the second path of travel.

* * * * *